US010643465B1

(12) United States Patent
Girardot et al.

(10) Patent No.: US 10,643,465 B1
(45) Date of Patent: May 5, 2020

(54) DYNAMIC ADVANCED TRAFFIC DETECTION FROM ASSESSMENT OF DILEMMA ZONE ACTIVITY FOR ENHANCEMENT OF INTERSECTION TRAFFIC FLOW AND ADJUSTMENT OF TIMING OF SIGNAL PHASE CYCLES

(71) Applicant: ITERIS, INC., Santa Ana, CA (US)

(72) Inventors: Brian R. Girardot, Sacramento, CA (US); Todd W. Kreter, Irvine, CA (US); Michael T. Whiting, Rancho Santa Margarita, CA (US)

(73) Assignee: ITERIS, INC., Santa Ana, CA (US)

( * ) Notice: Subject to any disclaimer, the term of this patent is extended or adjusted under 35 U.S.C. 154(b) by 0 days.

(21) Appl. No.: 16/687,486

(22) Filed: Nov. 18, 2019

(51) Int. Cl.
*G08G 1/01* (2006.01)
*G08G 1/07* (2006.01)
*G08G 1/052* (2006.01)

(52) U.S. Cl.
CPC ..... *G08G 1/0145* (2013.01); *G08G 1/0133* (2013.01); *G08G 1/052* (2013.01); *G08G 1/07* (2013.01)

(58) Field of Classification Search
USPC ..... 340/907
See application file for complete search history.

(56) References Cited

U.S. PATENT DOCUMENTS

2013/0279392 A1* 10/2013 Rubin ..... H04W 4/40 370/312
2019/0272747 A1* 9/2019 Raamot ..... G08G 1/0129
2019/0333374 A1* 10/2019 Overstreet ..... G06F 21/32

* cited by examiner

*Primary Examiner* — Brent Swarthout
(74) *Attorney, Agent, or Firm* — Lazaris IP

(57) ABSTRACT

A framework for precision traffic analysis estimates dilemma zone activity to dynamically adjust phase cycle timing for improved efficiency of traffic flow at a roadway intersection. The framework identifies a traffic detection area at or near a traffic intersection, and detects objects in the traffic detection area from sensors located proximate to the traffic intersection. The framework then correlates lapsed phase cycle times for the traffic signal with associations between object characteristics and known speed characteristics for the roadway for a determination of whether there is dilemma zone activity for the remainder of that phase cycle. The framework then determines whether to adjust a timing of the current phase cycle.

20 Claims, 3 Drawing Sheets

DYNAMIC ADVANCED TRAFFIC DETECTION FROM ASSESSMENT OF DILEMMA ZONE ACTIVITY FOR ENHANCEMENT OF INTERSECTION TRAFFIC FLOW AND ADJUSTMENT OF TIMING OF SIGNAL PHASE CYCLES

FIELD OF THE INVENTION

The present invention relates generally to the field of traffic management. More specifically, the present invention relates to traffic control systems, and to methods of dynamically adjusting timing of phase cycles for signals in traffic intersection environments, by evaluating dilemma zone activity based on current cycle timing and associations of speed and position of objects with known speed data in or near traffic intersections.

BACKGROUND OF THE INVENTION

There are many conventional traffic detection systems. Conventional systems typically utilize one or more sensor types, either in the roadway itself, or positioned at a roadside location or on traffic lights proximate to the roadway, to observe traffic patterns and detect specific objects. The most common type of sensors used are inductive coils, or loops, embedded in a road surface. Other existing systems utilize video cameras, radar sensors, acoustic sensors, or magnetometers, either in the road itself, or at either the side of a roadway or positioned higher above traffic to observe and detect vehicles and other objects in a desired area. Each of these sensors provide information used to determine a presence of vehicles and objects in specific lanes in intersections, and provide this information to traffic signal controllers for proper actuation.

This information is also useful for traffic and intersection management, in a variety of ways. For example, information from these sensors may be used for real-time decision-making pertaining to high speed approaches in enhanced "dilemma zone" precision, such as for example when a vehicle enters an area (known as the "dilemma zone") in which the driver must decide whether to stop or proceed through an intersection with a changing signal.

When a traffic signal changes from green to yellow, drivers approaching the intersection will fall into 3 categories: 1) close enough to the stop line to safely traverse the intersection, 2) far enough back from the stop line to safely stop the vehicle, or 3) caught in a dilemma zone of whether to stop or proceed through the signal. It is well known in the transportation management industry that drivers can be caught in this dilemma zone. Depending on driver attitude, road conditions, and traffic conditions, the driver may stop the vehicle or accelerate through the intersection. Either situation may increase the risk of an accident.

Many existing systems and methods are available to traffic engineers for detecting when a vehicle may be in the dilemma zone, and they can choose a number of traffic control options to deal with this. They may, for example, hold a yellow phase cycle of the traffic signal to allow the vehicle to pass through the intersection before changing the next phase to green, and they may hold all phases in red to allow the vehicle to pass through the intersection before changing the next phase to green. Either of these solutions will reduce the risk of an accident. However, both of these solutions will negatively affect the efficient operation of the intersection and reduce overall traffic flow.

Phase timing at traffic signals occurs in cycles, and there are many methods of performing phase cycles at intersections. However, as traffic patterns change throughout the course of a day, interruptions to the timing for those phase cycles may occur for many different reasons. For example, simple roadway congestion, first responder/emergency vehicle interruptions, use of the intersection by slower moving users such as cyclists and pedestrians, and changes in dilemma zone behavior all affect timing of phase cycles, and there is no current approach for adjusting phase cycle timing at traffic intersections to account for these interruptions.

Accordingly, there is a need in the existing art for improvements in intersection traffic flow by adjusting phase cycle timing as traffic patterns change. There is also a need in the existing art for dynamically evaluating dilemma zone activity at a traffic intersection, and incorporating this information into traffic flow decision-making for making real-time adjustments to phase cycles of traffic signals.

BRIEF SUMMARY OF THE INVENTION

The present invention provides a framework for enhanced traffic signal control in one or more systems and methods for reducing the impact of interruptions to phase cycles of traffic signals on traffic flow efficiency, based on an analysis of objects active or present in a dilemma zone. This framework identifies a traffic detection area at or near a traffic intersection, and detects objects in the traffic detection area from sensors located proximate to the traffic intersection. Position (in terms of distance relative to trigger points) and speed of these objects are then evaluated relative to posted speeds or average estimated speeds, and lapsed phase cycle times for the traffic signal which they are approaching, for a determination of whether those objects are in the dilemma zone for the remainder of that phase cycle. The framework then determines whether to adjust a timing of the current phase cycle to delay a change to the next phase cycle, and generates an output to a traffic signal controller accordingly.

It is therefore one objective of the present invention to provide a system and method for identifying multiple objects in a field of view of a roadway approaching a traffic intersection using multiple sensor systems. It is another objective of the present invention to provide a system and method of accurately measuring the speed and distance of objects within an identified traffic detection area comprising the field of view, using data from different types of sensors. It is still another objective to provide a system and method of assessing dilemma zone activity based on lapsed phase cycle times and characteristics of objects in the traffic detection area, in relation to known speed information for that particular roadway. It is a further objective to provide a dynamic output to a traffic signal controller to adjust phase cycle times and aid in operational efficiency based on dilemma zone activity and timing. It is still a further objective to provide a system and method to estimate the remaining phase cycle timing for a traffic signal based on historical data, and to use this information into the assessment of dilemma zone activity.

Other objects, embodiments, features and advantages of the present invention will become apparent from the following description of the embodiments, taken together with the accompanying drawings, which illustrate, by way of example, the principles of the invention.

BRIEF DESCRIPTION OF THE SEVERAL VIEWS OF THE DRAWINGS

The accompanying drawings, which are incorporated in and constitute a part of this specification, illustrate several embodiments of the invention and together with the description, serve to explain the principles of the invention.

DETAILED DESCRIPTION OF THE INVENTION

In the following description of the present invention reference is made to the exemplary embodiments illustrating the principles of the present invention and how it is practiced. Other embodiments will be utilized to practice the present invention and structural and functional changes will be made thereto without departing from the scope of the present invention.

Figure 1:
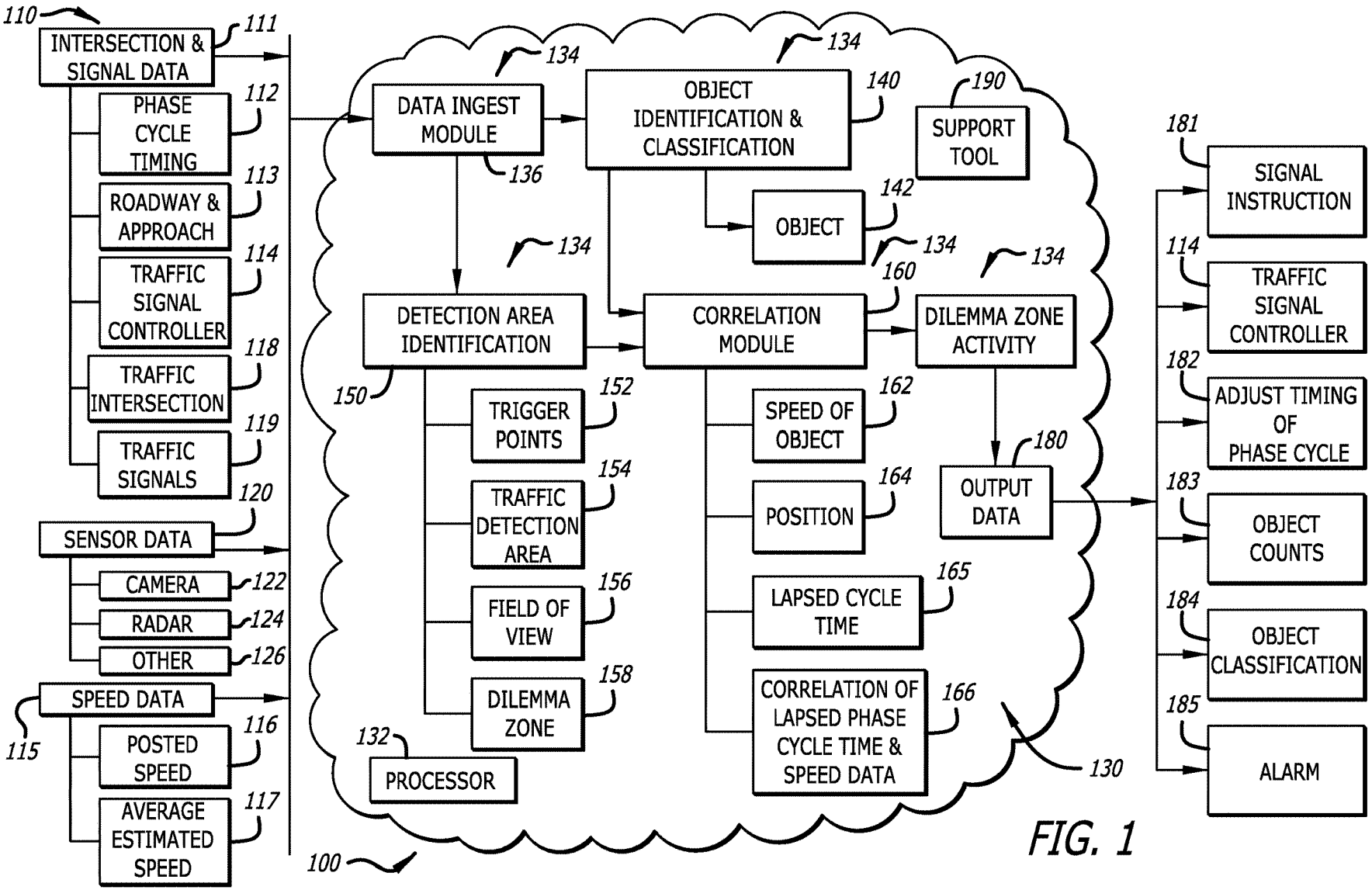
FIG. 1 is a system diagram for an enhanced traffic signal control framework according to one aspect of the present invention.

FIG. 1 is a system diagram of an enhanced traffic signal control framework 100 in which sensor data 120 captured by different types of sensors are analyzed to detect objects 142 in a roadway(s) 113, for example at or near a traffic intersection 118, for evaluating activity in a dilemma zone 158 during one or more phases of traffic signals 119 at the traffic intersection 118. The framework 100 is performed within one or more systems and/or methods that includes several components, each of which define distinct activities and functions for analyzing sensor data 120 collected from different types of sensors, and for accurately evaluating speed and position of objects 142 in a traffic detection area 154 within a field of view 156 of the sensors relative to the traffic intersection 118, for improvements in signaling and control, and public safety.

The enhanced traffic signal control framework 100 ingests, receives, requests, or otherwise obtains input data 110 that includes many types of information relative to a roadway 113 approaching or leaving a traffic intersection 118. This input data 110 includes intersection and signal data 111, which further includes phase cycle timing data 112 for traffic signals 119 relative to a roadway/approach 113 for the traffic intersection 118. As noted below in more detail, in most traffic intersections 118 where lighted traffic signals 119 are present, the traffic signals 119 for each approach are operated according to phases, each of which may have a particular timing and sequence, and which are controlled by a traffic signal controller 114.

Input data 110 also includes sensor data 120 comprised at least of images and reflected signals for the traffic detection area 154 within the field of view 156 of a roadway or roadways 113 as noted above. Images and reflected signals in the input data 110 are obtained from different types of sensors, each of which collect data relative to a field of view 156 of the roadway 113 and which may be positioned in or near areas of interest for which trigger points 152 are to be identified. The sensors collectively comprise a detection system, and may include video systems 122 such as cameras and thermal cameras, radar systems 124, and other sensors 126 which may be configured to collect data from a field of view 154 or a roadway 113 itself, such as magnetometers, acoustic sensors, inductive loops, and any other devices or systems which are capable of detecting a presence of and object 142 within a traffic environment, and enabling identification of trigger points 152 which define a traffic detection area 154. It is to be understood that any combination of such sensors, and sensor data 120 collected therefrom, may be used in such a traffic environment.

Input data 110 also includes speed data 115 for the roadway 113. Speed data may include both a posted speed limit 116, and an average estimated speed 117, which may be the product of surveys, taken over time, of actual roadway usage. Posted speed 116 and average estimated speed 117 may also be maintained and provided by the traffic signal controller 114, supplied by 3$^{rd}$ party providers, or at least in the case of average estimated speed 117, derived from the sensor data 120.

Regardless, and as noted above, the enhanced traffic signal control framework 100 of the present invention operates in conjunction with a traffic signal controller 114, and is designed to generate output data 180 that is communicated to the traffic signal controller 114 to, in one embodiment of the present invention, delay a change in phase cycle, and therefore alter a programmed phase cycle timing, due to a presence of one or more objects 142 in a dilemma zone 158. The enhanced traffic signal control framework 100 therefore represents an improvement upon existing approaches to control of phase cycles for traffic signals 119 that occupy a traffic intersection 118 that are unable to dynamically modify phase cycle timing 112 due to detected activity.

Figure 2:
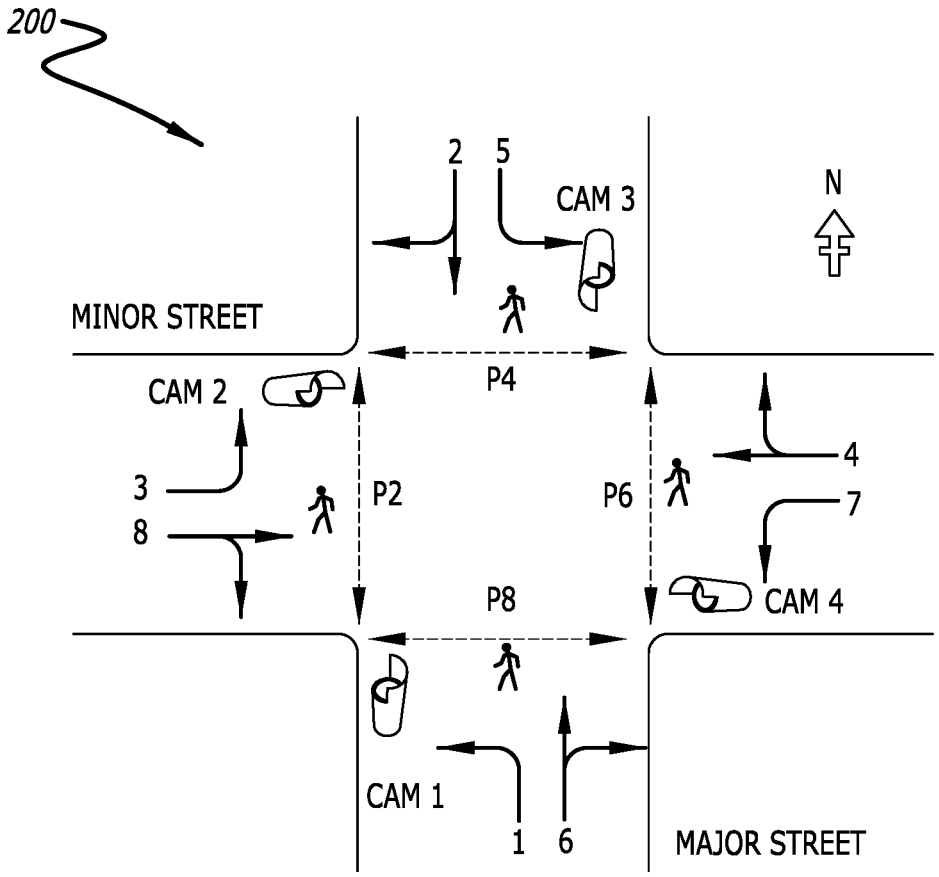
FIG. 2 is a diagram of exemplary phase cycles for a traffic intersection.

FIG. 2 is a diagram of a typical phase cycle layout 200 at a traffic intersection 118. In a signalized traffic intersection 118, the control of phase cycles of the different traffic signal lights at each roadway or approach 113 is managed by a traffic signal controller 114 as noted above. This traffic signal controller 114 may perform several modes. In one such mode, the traffic signal controller 114 runs a 'fixed' time pattern, where no detection of vehicles or other roadway users is required. The traffic signal controller 114 may be configured to run this pattern continuously irrespective of traffic density on any particular approach 113 to the traffic intersection 118.

In another mode, the traffic signal controller 114 may run what is known as 'free time'. In this mode, detection of vehicles and other roadway users are provided to the traffic signal controller 114, which will provide green traffic signals when a vehicle is present. No priority is given to any one approach 113, and green traffic signals are given to the first object detected. In this operational mode a minimum green time is programmed for each phase to ensure that vehicles may safely traverse the traffic intersection 118 before the phase changes.

A more common approach for traffic signal control is to have a timing coordination plan for busier phase cycles, where approaches having greater traffic density are given more green traffic signal time compared to other approaches with less traffic density. This approach allows for a greater efficiency of traffic movement. The goal of the traffic engineer or planner is to reduce or avoid congestion. Such an operational mode requires a high degree of accuracy in detection of roadway users, such as vehicles, bicycles, pedestrians, etc.

In the enhanced traffic signal control framework 100, a region of interest may be drawn at various locations in a field of view 156 on a roadway 113 approaching a traffic intersection 118, for example near a stop bar, and detections in the region of interest serve to indicate to the traffic controller 114 that roadway users are present. A region of interest may also include an advanced location away from the stop bar to indicate to the traffic signal controller 114 whether more roadway users will be present at the stop bar in a short amount of time. Such an advanced detection location can be used to extend a green phase until a maximum programmed phase time has been reached, or to terminate the green phase early, where the detection paradigm applied in the region of interest fails to indicate a presence of more roadway users. Advanced detection locations are used to analyze dilemma zone situations, as discussed further below.

While a coordinated plan for phase cycle timing for traffic signals provides for an efficient movement of traffic, timing may be interrupted by a number of causes. One of these causes might be the presence of a first responder vehicle, such as a fire truck, police car or ambulance, which are equipped with devices to communicate with traffic signal controllers to preempt the timing of phase cycles and immediately turn all phases red except for the intersection approach on which the first responder vehicle is traveling. This situation interrupts the ideal traffic flow, and it takes a number of complete phase cycles for phase cycle patterns to return to normal.

Another cause for interruption to phase cycle timing is a request for pedestrian crossing, or the presence generally of pedestrians wishing to cross. This often results in an extension of the timing of the green phase adjacent to a crosswalk that pedestrian has requested to use. When the pedestrian crossing button is pressed the traffic signal controller has to provide a minimum crossing time based on the length of the crosswalk and the current requirements as laid out in the MUTCD specification. This interruption of the normal phase cycle timing will also affect cycle time.

Also, changes or interruptions to the normal phase cycle timing often occur from the presence of cyclists. In some jurisdictions it is required by law to provide extended minimum green phase time when there is a cyclist present. In other jurisdictions that are bicycle-friendly, traffic engineers may make accommodations for cyclists even if not required by law. In either case the phase cycle timing 112 may change when the cyclist is present.

Another way in which phase cycle timing may be interrupted is due to the detection of objects in the dilemma zone. A dilemma zone is a well-known phenomenon in the traffic industry, and is defined generally as an area from approximately 2.5 seconds to approximately 5.5 seconds in advance of the stop bar, based on the posted speed limit. The dilemma zone is active as the signal for an intersection approach turns to yellow. At this moment, roadway users have to make a decision whether to continue and move through the intersection or to stop at the stop bar.

Most roadway users within 2.5 seconds of the stop bar will continue to travel and clear the intersection. Most roadway users more than 5.5 seconds from the stop bar will apply brakes and stop their vehicle at the stop bar. The dilemma comes from those roadway users between 2.5 seconds and 5.5 seconds. Their decision to stop or go is based on a number of criteria; their driving style, the road conditions, wet or dry, the volume of other traffic on the roadway are among some of these.

Systems have been in place for many years to identify roadway users in the dilemma zone, originally with loop sensors and progressing to the application of many different sensor types, such as video and radar sensors. These sensors provide an input to the traffic signal controller where a vehicle is present in the dilemma zone, which is then programmed to respond in one of a number of possible ways. One such way is to extend the yellow phase, which allows the roadway user to safely traverse the intersection before conflicting traffic is given a green phase. Another way is to allow the yellow phase to expire, but hold all other phases at the traffic intersection as red to allow the roadway user to safely traverse the traffic intersection before conflicting traffic is given a green phase. Both of these provide a solution to the problem of roadway users in the dilemma zone. Both solutions also cause the interruption to the ideal traffic flow, and it takes a number of complete phase cycles for traffic patterns to return to normal.

Returning to FIG. 1, the input data 110 is applied to a plurality of data processing modules 134 within a computing environment 130 that also includes one or more processors 132, a plurality of software and hardware components, and one or more modular software and hardware packages configured to perform specific processing functions. The one or more processors 132, plurality of software and hardware components, and one or more modular software and hardware packages are configured to execute program instructions to perform algorithms for various functions within the enhanced traffic signal control framework 100 that are described in detail herein, and embodied in the one or more data processing modules 134.

The plurality of data processing modules 134 include a data ingest component 136 configured to ingest, receive, request, or otherwise obtain the input data 110 as noted above. This information is provided to traffic detection area identification module 150, which is configured to identify a plurality of trigger points 152 which are used to define one or more areas of interest within the roadway(s) 113 that become the traffic detection area 154 and which further define a dilemma zone 158.

The plurality of trigger points 152 may include a first plurality of trigger points 152 that represent a stop bar proximate to the traffic signal 119 at the traffic intersection 118, and may be based on the at least one of the posted speed 116 and the average estimated speed 117. The plurality of trigger points 152 may also include a plurality of second trigger points 152 represent an advanced detection location in the field of view 156, and may be based on an amount of time lapsed 165 in at least one phase cycle. Together, the plurality of first trigger points 152 and the plurality of second trigger points 152 define a dilemma zone 158 for the traffic detection area 154, from which correlations of object characteristics are analyzed to determine if there is activity in this dilemma zone 158 that requires delaying the current phase cycle timing 112 of the traffic signal 119 which the object 142 is approaching.

The framework 100 then performs a correlation module 160 to determine, as noted above, whether there is dilemma zone activity 170 in the traffic detection area 154. The correlation module 160 is initially configured to determine a speed 162 of a detected object 142 in the traffic detection area 154 by associating the object 142 with its position relative to the plurality of first trigger points 152 and the plurality of second trigger points 152 to determine a distance between one point and another point (spatial information), and also a position 164 of the object 142, by associating the object 142 with its position relative to the plurality of first trigger points 152 and the plurality of second trigger points 152 to calculate a time for the object 142 to pass from one of the first trigger points 152 to one of the second trigger points 152 (temporal information). The module 160 is further configured to correlate the amount of time lapsed 165 in the at least one phase cycle, with an association between the speed of the detected object and one or more of the posted speed 116 and an average estimated speed 117, knowing its' position relative to the plurality of trigger points 152. The speed 162 and position 164, and the correlation 166 performed by the module 160, is used to determine, in module 170, both a presence of the object 142 in the dilemma zone 158, and whether an adjustment 182 should be made to the timing 112 of the current phase cycle. Such an adjustment 182 is made where the speed 162 of the object 142 is within a pre-specified percentage of the one or more of the posted speed 116 and the average estimated speed 117, and the amount of time lapsed 165 is within a pre-specified percentage range of remaining time of the current phase cycle.

Many different correlations 166 may be used by the enhanced traffic signal control framework 100 to determine whether to generate an instruction 181 to adjust 182 or alter the timing 112 of an existing phase cycle based on dilemma zone activity. In one embodiment, this may be based on the 85th percentile of the roadway's speed survey, the posted speed limit 116, or other estimation of average speed 117 for the roadway 113 being analyzed, as follows. Within the first 25% of the estimated phase cycle time of a green phase cycle for the approach that includes the designated traffic detection area 154, all objects 142 detected at the stop bar trigger line, or at the trigger line set for advanced detection, cause the enhanced traffic signal control framework 100 to generate and send a signal to the traffic signal controller 114 comprising an instruction 181 to extend the existing phase cycle. During the next 26% to 50% of the estimated phase cycle time, the enhanced traffic signal control framework 100 only generates and sends a signal to the traffic signal controller 114 comprising an instruction 118 to extend the existing phase cycle if the object or objects 142 detected are within 66% of the posted speed limit 116 or estimated average speed 117. During the next 51% to 75% of the estimated phase cycle time, the enhanced traffic signal control framework 100 only generates and sends a signal to the traffic signal controller 114 comprising an instruction 181 to extend the existing phase cycle if the object or objects 142 detected are within 40% of the posted speed limit 116 or estimated average speed 117. During the remainder of the current phase cycle time, the enhanced traffic signal control framework 100 only generates and sends a signal to the traffic signal controller 114 comprising an instruction 181 to extend the existing phase cycle if the object or objects 142 detected are within 85% of the posted speed limit 116 or estimated average speed 117. Finally, once a red phase cycle has been identified for the approach comprising the designated traffic detection area 154, the threshold values for determining whether to send an output are reset.

The approach of the present invention allows traffic engineers or planners to rely less on a detection area comprised of the stop bar during the green phase and place increased reliance on the advanced detection area further from the stop bar to keep traffic flow on the roadway optimal. This approach also identifies gaps in the traffic flow of the roadway sooner, and therefore allows traffic movement for left turn phases and phases on the intersecting roadway to be serviced more efficiently. It also aids traffic engineers to maintain coordinated timing plans when considering interruptions to ideal vehicle/driver behavior.

The plurality of data processing modules 134 may also include one or more object identification and classification components 140, which are configured to identify and classify objects 142 within the traffic detection area 154. This module 140 may also be configured to generate information related to types and classifications of objects 142 and counts thereof, and this information may be included as noted below as a part of the output data 180.

The enhanced traffic control framework 100 generates output data 180 in response to a determination of activity in the dilemma zone 158 and the correlation 166 of lapsed phase cycle time with the associated speed of the object 142 with known speed data 115. This output data 180 may include a signal or instruction 181 to a traffic signal controller 114, to adjust 182 a timing 112 of a current phase cycle, for example as noted above to delay a change in the current phase cycle to accommodate the activity in the dilemma zone 158. The signal or instruction 181 may, alternatively, represent an indication not to adjust the current phase cycle, for example where there is no activity in the dilemma zone 158 or where the activity therein will not affect the timing 112 for the phase cycles of the traffic signals 119 at the traffic intersection 118.

The signal or instruction 181 may represent an indicator to perform various actions relative to the phase cycles of the traffic intersection 118 that accomplish adjusting 182 the timing 112 of phase cycles. This may include extending a current green or yellow phase, or holding one or more red phases longer for a roadway 113 intersecting the one for which the current phase cycle is active. It is to be understood therefore that many adjustments 182 to phase cycle timing 112 are possible, and within the scope of the content of a signal or instruction 181 and the present invention.

Other types of output data 180 are also contemplated as part of the enhanced traffic signal control framework 100. Output data 180 may include object counts 183 indicative of the number of objects 142 in the traffic detection area 154, either generally or for specific periods of time. Output data 180 may also include types of objects 142 in object classifications 184, which indicate whether the object 142 is a passenger vehicle, a bicycle, a truck or larger commercial vehicle, a pedestrian, an incident, or other type of object 142 which may be present in the roadway 113. Output data 180 may also represent an alarm 185, for example in a signal 181 that instructs the traffic controller 114 (or any other nearby device or system) to generate verbal, visual, aural, or other indications that a problem has been detected in the traffic detection area 154. Alarms 185 may be configured to warn of many different incidents or activities in a roadway 113 that can cause abnormal activity or movements. For example, incidents may include prone objects 142 such as pedestrians that may have fallen to the pavement, the presence of unauthorized vehicles in a crosswalk, or a pedestrian attempting to cross the intersection while crossing traffic has a green phase cycle. Alarms 185 may also be sent to vehicles themselves that are in the dilemma zone 158 as a warning, via instruments or computing systems onboard such vehicles, again as either verbal, visual, aural, or other indications.

Identification of the traffic detection area 154 may vary from intersection to intersection and roadway to roadway, and it is to be noted that the placement of trigger points 152 for the region of interest for both stop bar and advanced detection zones for dilemma zone analytics may be based on studies performed for the roadway 113 and traffic intersection 118 being analyzed, on the posted speed limit 116, and on current conditions at the geographical location of the traffic intersection 118. Therefore, it is to be understood that the position of trigger points or lines 152 may change, and one aspect of the present invention is to identify the position of such trigger points or lines 152 to properly identify moving objects 142 and analyze dilemma zone activity.

Regardless, at any given traffic intersection, the two intersecting roadways may be considered major or minor. Normally, the highest density of traffic volume is designated the major roadway, and traffic engineers optimize the phase cycle timing based on the major roadway. The major roadway is therefore given greater priority in the traffic signal timing patterns.

At a traffic intersection where a coordinated timing pattern has been implemented, an optimal green phase timing for each approach is calculated and stored in the traffic signal controller. In addition to the interruptions to timing mentioned above, other elements also affect the cycle timing for each phase. As traffic density changes through the day, more demand may appear on the minor approaches or less demand may appear on the major approaches. Such a natural fluctuation in traffic flow also affects the timing of phase cycles.

Although coordinated phase cycle timing is programmed into the traffic signal controller, detection systems may not have access to information indicating that the ideal phase cycle time is not always the same as that which would be measured in real time. Therefore, detection systems need access to phase cycle timing to perform more accurate measurements. Access to the phase cycle outputs can be achieved in a number of ways.

For example, a traffic signal controller and a system of detection sensors may each be equipped with a common communications bus, such as the SDLC port in a NEMA TS-2 specified cabinet, or Ethernet communications in a SPaT (Signal Phase and Timing) equipped or similar alternative communication systems that are common to traffic cabinet installations. In such a communications environment, the current state of each phase can be identified by monitoring the communications data and identifying when phase states change.

Alternatively, if the traffic cabinet and traffic signal controller are not equipped with a common communications system, but the detection system has electrical logic level inputs, an interface panel may be coupled to the output signals of the traffic signal controller, and connected by wire or cable to the detection system. In this way the detection system can directly identify the current state of each phase cycle through the electrical signal set to the load switch which activates the various lights on the traffic signal.

With access to the phase state of the traffic signal, a detection system is able to measure and record the length of each phase cycle. Over time, as multiple measurements are accumulated, an average phase cycle timing may be calculated. As mentioned previously, phase cycle times may diverge from ideal programmed times over the course of a day for various reasons. The detection system may be programmed to discard measured cycle times from earlier in a day, and calculate the average over the last x number of phases. By discarding older measurements, average cycle time can continue to follow traffic patterns.

Figure 3:
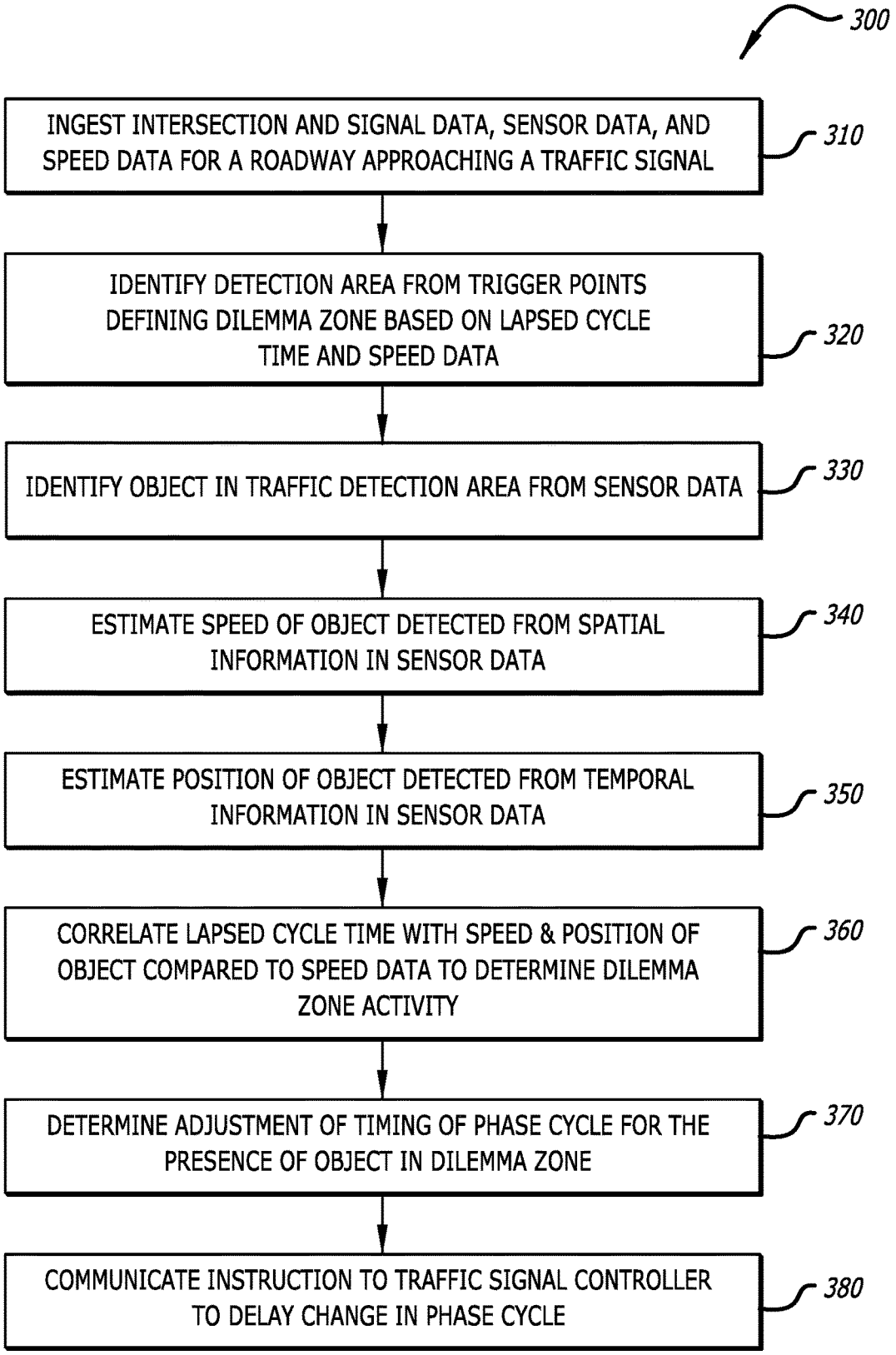
FIG. 3 is a flowchart of steps performed for the enhanced traffic signal control framework according to another aspect of the present invention.

FIG. 3 is a flowchart illustrating steps in a process 300 for performing the enhanced traffic signal control framework 100, according to certain embodiments of the present invention. Such a process 300 may include, as noted above one or more functions, mathematical models, algorithms, machine learning processes, and data processing techniques for the components and modules 134 that ingest input data 110 and perform detection area 154 identification, correlations 166 of lapsed cycle times and associated speed data, dilemma zone activity determinations 170, and object classification within such a framework 100, and for the various analytical approaches applied within each component and module 134.

The process 300 is initialized at step 310 by retrieving and ingesting input data 110 representing intersection and signal data 111, speed data 115, and sensor data 120 data collected by the sensor systems for a roadway and approach 113 for one or more traffic signals 119 at a traffic intersection 118. The process 300 then identifies a traffic detection area 154 from a field of view 156 and trigger points 152 defining a dilemma zone 158 for the roadway 113 at step 320. At step 330, the process 300 then analyzes the sensor data 120 to identify one or more objects 142 in the traffic detection area 154.

The process 300 then begins its analysis of dilemma zone activity performed by the various data processing modules and components 134 at steps 340 and 350, by estimating a speed 162 of an object 142 from spatial information in the sensor data 120, and estimating a position 164 of the object 142 from temporal information in the sensor data 120. These estimates of speed 162 and position 164 then allow the process 300 to analyze whether there is activity in the dilemma zone 158 in module 170 that is sufficient to justify adjusting a phase cycle timing 112 for a traffic signal.

This occurs at step 360 by correlating a lapsed cycle time 166 with an associating between the speed 162 and position 164 of the object 142 and known speed data 115 such as a posted speed 116 or an average estimated speed 117. If the object 142 is determined to be in a particular location relative to the trigger points 152, and is traveling a known speed, this can be compared to the speed data 115 at step 370 to determine whether an adjustment is necessary relative to the amount of time lapsed 165 in the current phase cycle as discussed above. If the threshold speeds and amounts of time lapsed 165 are met, and a determination to adjust has been made at step 370, the process 300 proceeds to communicate an instruction at step 380 to the traffic signal controller 114 to delay a change in the current phase cycle.

In one embodiment of the present invention, a user may configure one or more aspects of the enhanced traffic signal control framework 100 using a traffic management support tool 190. A user may interact with the support tool 190 via an application resident on a computing device and/or using a graphical user interface, and various aspects of the enhanced traffic signal control framework 100 may be configured in a number of ways using the traffic management support tool 190.

For example, settings may be adjusted for how traffic detection areas 154 are determined, for example where a stop bar should be located or where advanced detection zones should be located based relative to positioning of the sensor systems or characteristics thereof via the traffic management support tool 190. Additionally, a user may select a specific size and location of a field of view 156 in relation to a traffic intersection 118, or other portion of a roadway 104. In other words, the field of view 156, and traffic detection areas 154 (or characteristics thereof) may be pre-selected by a user prior to performance of the data processing paradigms defined herein, and may also be adjusted by the user during system performance.

The traffic management support tool 190 may also include the ability to adjust the specific correlations 166 made between the lapsed cycle time and associations between object speed/position and the speed data 115, for example due to changes in weather or known adjustments made to phase cycle timing 112. The traffic management support tool 190 may include widgets, drop-down menus, and other indicia presented via the graphical user interface that enable a user to make selections and perform functions attendant to operation of the enhanced traffic signal control framework 100.

The systems and methods of the present invention may be implemented in many different computing environments 130. For example, they may be implemented in conjunction with a special purpose computer, a programmed microprocessor or microcontroller and peripheral integrated circuit element(s), an ASIC or other integrated circuit, a digital signal processor, electronic or logic circuitry such as discrete element circuit, a programmable logic device or gate array such as a PLD, PLA, FPGA, PAL, and any comparable means. In general, any means of implementing the methodology illustrated herein can be used to implement the various aspects of the present invention. Exemplary hardware that can be used for the present invention includes computers, handheld devices, telephones (e.g., cellular, Internet enabled, digital, analog, hybrids, and others), and other such hardware. Some of these devices include processors (e.g., a single or multiple microprocessors or general processing units), memory, nonvolatile storage, input devices, and output devices. Furthermore, alternative software implementations including, but not limited to, distributed processing, parallel processing, or virtual machine processing can also be configured to perform the methods described herein.

The systems and methods of the present invention may also be wholly or partially implemented in software that can be stored on a non-transitory computer-readable storage medium, executed on programmed general-purpose computer with the cooperation of a controller and memory, a special purpose computer, a microprocessor, or the like. In these instances, the systems and methods of this invention can be implemented as a program embedded on a mobile device or personal computer through such mediums as an applet, JAVA® or CGI script, as a resource residing on one or more servers or computer workstations, as a routine embedded in a dedicated measurement system, system component, or the like. The system can also be implemented by physically incorporating the system and/or method into a software and/or hardware system.

Additionally, the data processing functions disclosed herein may be performed by one or more program instructions stored in or executed by such memory, and further may be performed by one or more modules configured to carry out those program instructions. Modules are intended to refer to any known or later developed hardware, software, firmware, artificial intelligence, fuzzy logic, expert system or combination of hardware and software that is capable of performing the data processing functionality described herein.

The foregoing descriptions of embodiments of the present invention have been presented for the purposes of illustration and description. It is not intended to be exhaustive or to limit the invention to the precise forms disclosed. Accordingly, many alterations, modifications and variations are possible in light of the above teachings, may be made by those having ordinary skill in the art without departing from the spirit and scope of the invention. It is therefore intended that the scope of the invention be limited not by this detailed description. For example, notwithstanding the fact that the elements of a claim are set forth below in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a sub-combination or variation of a sub-combination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what essentially incorporates the essential idea of the invention.

The invention claimed is:

1. A method, comprising:

ingesting input data that includes phase cycle data representing a timing for at least one phase cycle for a roadway approaching a traffic intersection, sensor data captured from a field of view representing a traffic detection area for the roadway approaching the traffic intersection, and at least one of a posted speed and an average estimated speed for the roadway approaching the traffic intersection;

analyzing the input data within a computing environment in a plurality of data processing modules executed in conjunction with at least one specifically-configured processor, the data processing modules configured to analyze dilemma zone activity to determine an adjustment of the timing for the at least one phase cycle, by defining a plurality of first trigger points in the traffic detection area, based on the at least one of the posted speed and the average estimated speed, and defining a plurality of second trigger points in the traffic detection area based on an amount of time lapsed in the at least one phase cycle, wherein the plurality of first trigger points and the plurality of second trigger points define a dilemma zone for the traffic detection area;

analyzing spatial information in the field of view, by evaluating the sensor data to estimate a speed of at least one object between the plurality of first trigger points and the plurality of second trigger points;

analyzing temporal information in the field of view, by evaluating the sensor data to estimate a position of the at least one object between the plurality of first trigger points and the plurality of second trigger points;

correlating a lapsed cycle time in the phase cycle data with an association between the speed of the at least one object and one or more of the posted speed and an average estimated speed, and generating an indicator of dilemma zone activity where an object is moving at a particular speed relative to the lapsed cycle time within the traffic detection area; and generating, as output data, an instruction to a traffic signal controller to adjust the timing of the at least one phase cycle from the indicator of dilemma zone activity.

2. The method of claim 1, wherein the indicator of dilemma zone activity is generated when the particular speed is within a pre-specified percentage of the one or more of the posted speed and the average estimated speed, and the lapsed cycle time is within a pre-specified percentage range of remaining time of the at least one phase cycle.

3. The method of claim 1, wherein the average estimated speed is an 85th percentile of a speed survey for the roadway within the traffic detection area.

4. The method of claim 1, wherein the sensor data includes data captured from one or more of a radar sensor, a video camera, a thermal camera, a magnetometer, an inductive loop, a light-based sensor, and an acoustic sensor.

5. The method of claim 1, wherein the traffic detection area includes a stop bar represented by the plurality of first trigger points, and an advanced detection location represented by the plurality of second trigger points.

6. The method of claim 1, wherein the phase cycle data is provided by a traffic signal controller associated with the traffic intersection.

7. A method for adjusting a timing of a phase cycle for a traffic signal, comprising:

identifying a traffic detection area on a roadway approaching a traffic intersection, by defining a plurality of first trigger points based on at least one of a posted speed and an average estimated speed for the roadway, and defining a plurality of second trigger points based on at least one phase cycle for a traffic signal, wherein the traffic detection area defines a dilemma zone based on an amount of time lapsed in the at least one phase cycle, and the at least one of the posted speed and the average estimated speed;

estimating a speed of at least one object between the plurality of first trigger points and the plurality of second trigger points from input data collected by one or more sensors for a field of view representing the traffic detection area;

estimating a position of the at least one object between the plurality of first trigger points and the plurality of second trigger points from the input data collected by the one or more for the field of view representing the traffic detection area;

correlating the amount of time lapsed in the at least one phase cycle with an association between the speed of the at least one object and one or more of the posted speed and an average estimated speed, to determine a presence of the at least one object in the dilemma zone; and adjust a timing of the at least one phase cycle for the presence of the at least one object in the dilemma zone, by communicating an instruction to a traffic signal controller to delay a change in the at least one phase cycle.

8. The method of claim 7, wherein the timing of the at least one phase cycle is adjusted when the speed of the least one object is within a pre-specified percentage of the one or more of the posted speed and the average estimated speed, and the amount of time lapsed is within a pre-specified percentage range of remaining time of the at least one phase cycle.

9. The method of claim 7, wherein the average estimated speed is an 85th percentile of a speed survey for the roadway within the traffic detection area.

10. The method of claim 7, further comprising ingesting phase cycle data that includes the at least one phase cycle for the traffic signal from the traffic signal controller.

11. The method of claim 7, wherein the estimating a speed of at least one object further comprises analyzing spatial information in the traffic detection area from input data collected by the one or more sensors located proximate to or near the roadway, and wherein the estimating a position of the at least one object further comprises analyzing temporal information in the designated traffic detection area from the input data collected by the one or more sensors located proximate to or near the roadway.

12. The method of claim 7, wherein the sensor data includes data captured from one or more of a radar sensor, a video camera, a thermal camera, a magnetometer, an inductive loop, a light-based sensor, and an acoustic sensor.

13. The method of claim 7, wherein the traffic detection area includes a stop bar represented by the plurality of first trigger points, and an advanced detection location represented by the plurality of second trigger points.

14. A traffic control system, comprising:

a computing environment including at least one computer-readable non-transitory storage medium having program instructions stored therein and a computer processor operable to execute the program instructions to determine an adjustment for at least one phase cycle of a traffic signal at a traffic intersection, the plurality of data processing modules including:

a data ingest module configured to ingest input data that includes phase cycle data representing a timing for the at least one phase cycle for a roadway approaching the traffic intersection, sensor data captured from a field of view representing a traffic detection area for the roadway approaching the traffic intersection, and at least one of a posted speed and an average estimated speed for the roadway approaching the traffic intersection;

a traffic detection area identification module configured to identify the traffic detection area on a roadway approaching a traffic intersection, by defining a plurality of first trigger points based on at least one of a posted speed and an average estimated speed for the roadway, and defining a plurality of second trigger points based on at least one phase cycle for a traffic signal, wherein the traffic detection area defines a dilemma zone based on an amount of time lapsed in the at least one phase cycle, and the at least one of the posted speed and the average estimated speed;

a dilemma zone correlation module configured to analyze spatial information and temporal information in the sensor data, to determine a presence of the at least one object in the dilemma zone, by estimating a speed of at least one object in the field of view and between the plurality of first trigger points and the plurality of second trigger points from input data collected by one or more sensors relative to the roadway, estimating a position of the at least one object in the field of view and between the plurality of first trigger points and the plurality of second trigger points from the input data collected by the one or more sensors relative to the roadway, and correlating the amount of time lapsed in the at least one phase cycle with an association between the speed of the at least one object and one or more of the posted speed and an average estimated speed, wherein a timing of the at least one phase cycle is adjusted for the presence of the at least one object in the dilemma zone, by communicating a signal to a traffic signal controller to delay a change in the at least one phase cycle.

15. The system of claim 14, wherein the timing of the at least one phase cycle is adjusted where the speed of the at least one object is within a pre-specified percentage of one or more of the posted speed and the average estimated speed, and the amount of time lapsed is within a pre-specified percentage range of remaining time of the at least one phase cycle.

16. The system of claim 14, wherein the average estimated speed is an 85th percentile of a speed survey for the roadway within the traffic detection area.

17. The system of claim 14, wherein the data ingest module is further configured to ingest phase cycle data that includes the at least one phase cycle for the traffic signal from the traffic signal controller.

18. The system of claim 14, wherein the spatial information and temporal information are collected by one or more sensors located proximate to or near the roadway.

19. The system of claim 14, wherein the sensor data includes data captured from one or more of a radar sensor, a video camera, a thermal camera, a magnetometer, an inductive loop, a light-based sensor, and an acoustic sensor.

20. The system of claim 14, wherein the traffic detection area includes a stop bar represented by the plurality of first trigger points, and an advanced detection location represented by the plurality of second trigger points.

* * * * *